US007974556B2

(12) United States Patent
Hori et al.

(10) Patent No.: US 7,974,556 B2
(45) Date of Patent: Jul. 5, 2011

(54) DEVELOPMENT DEVICE, PROCESS CARTRIDGE, AND IMAGE FORMING APPARATUS

(75) Inventors: Eisuke Hori, Tokyo (JP); Hideki Kimura, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 12/609,603

(22) Filed: Oct. 30, 2009

(65) Prior Publication Data

US 2010/0111572 A1 May 6, 2010

(30) Foreign Application Priority Data

Nov. 4, 2008 (JP) ..... 2008-283465
Sep. 4, 2009 (JP) ..... 2009-204876

(51) Int. Cl.
*G03G 15/04* (2006.01)

(52) U.S. Cl. ..... 399/254; 399/119

(58) Field of Classification Search ..... 399/119, 399/222, 252, 254–256, 258–260, 262–263
See application file for complete search history.

(56) References Cited

U.S. PATENT DOCUMENTS

| | | | | |
|---|---|---|---|---|
| 5,166,731 | A * | 11/1992 | Aimoto et al. | 399/103 |
| 5,283,616 | A * | 2/1994 | Numagami et al. | 399/111 |
| 5,923,931 | A * | 7/1999 | Kishimoto | 399/256 |
| 6,266,505 | B1 * | 7/2001 | Ban et al. | 399/258 |
| 6,505,026 | B2 | 1/2003 | Hayakawa et al. | |
| 6,826,381 | B2 | 11/2004 | Muramatsu et al. | |
| 7,043,182 | B2 | 5/2006 | Sakai et al. | |
| 7,212,773 | B2 | 5/2007 | Sudo et al | |
| 7,228,093 | B2 | 6/2007 | Sakai et al. | |
| 7,272,342 | B2 | 9/2007 | Nagashima et al. | |
| 7,325,908 | B2 | 2/2008 | Katoh et al. | |
| 7,457,570 | B2 | 11/2008 | Kasai et al. | |
| 7,540,598 | B2 | 6/2009 | Hori et al. | |
| 7,599,650 | B2 | 10/2009 | Katoh et al. | |
| 2005/0031374 | A1 | 2/2005 | Nagashima et al. | |
| 2008/0013982 | A1 | 1/2008 | Kimura | |
| 2008/0025743 | A1 | 1/2008 | Hori | |
| 2008/0094458 | A1 | 4/2008 | Bannai et al. | |
| 2008/0205937 | A1 | 8/2008 | Hori et al. | |
| 2009/0022504 | A1 | 1/2009 | Kuwabara et al. | |
| 2009/0047036 | A1 | 2/2009 | Hori et al. | |

FOREIGN PATENT DOCUMENTS

| | | |
|---|---|---|
| JP | 8-146765 | 6/1996 |
| JP | 2001-139153 | 5/2001 |
| JP | 2006-220852 | 8/2006 |

* cited by examiner

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

A development device includes a screw conveyer to convey powder contained in a development casing in a direction along a shaft of the screw conveyer, a bearing in which the screw conveyer is inserted, a cylindrical member provided around the screw conveyer and disposed between the screw conveyer and the bearing, the cylindrical member including a flange portion that projects from the cylindrical member toward an outside diameter of the shaft of the screw conveyer, and a powder pressure disperser to reduce pressure of the powder transported by the screw conveyer provided upstream from the flange portion in a direction in which the screw conveyer conveys the toner, the powder pressure disperser provided around and extending outward in directions perpendicular to the shaft of the screw conveyer and having an outer diameter larger than an outer diameter of the flange portion.

17 Claims, 8 Drawing Sheets

DEVELOPMENT DEVICE, PROCESS CARTRIDGE, AND IMAGE FORMING APPARATUS

CROSS-REFERENCE TO RELATED APPLICATIONS

This patent specification claims priority from Japanese Patent Applications No. 2008-283465, filed on Nov. 4, 2008 and 2009-204876, filed on Sep. 4, 2009 in the Japan Patent Office, which are hereby incorporated by reference herein in their entirety.

BACKGROUND OF THE INVENTION

1. Field of the Invention

The present invention relates to a process cartridge that includes a development device and is incorporated in an image forming apparatus such as a copier, a printer, a facsimile machine, a plotter, a multi-function machine, and the like.

2. Discussion of the Background

In general, development devices that develop toner images for electrophotographic printing employ either one-component developer or two-component developer. Structurally, known development devices using two-component developer consisting essentially of toner and magnetic carrier generally include a development casing and multiple toner screw conveyers supported by bearings formed in the casing to agitate and transport supplied toner and carrier, with the toner screw conveyers generally formed of a shaft with a bladed spiral portion so as to transport the toner unidirectionally. A first toner screw conveyer and a second toner screw conveyer are respectively provided in a development roller chamber and an agitation chamber. As the toner is consumed, more toner is supplied from an upper portion of the agitation chamber in a direction in which the toner is transported (hereinafter "toner transport direction"). The replenished toner is mixed with the carrier in the agitation chamber and is conveyed toward a downstream portion of the agitation chamber along the spiral portion of the toner screw conveyor.

In the development devices including the above-described toner screw conveyers, unless the shaft of each toner screw conveyer is almost perfectly round the toner may leak from between the bearings and the toner screw conveyor. Therefore, a collar or the like that can be perfectly round relatively easily is fitted around the toner screw conveyor between the bearing and the toner screw conveyor.

Additionally, in order to fit the collar around the screw shaft of the toner screw conveyer without damaging the screw shaft by pressing tools, a flange portion may be provided on the collar.

In the known development devices configured as described above, a driving mechanism to rotate the screw conveyors and a development roller is provided on the outside of the development casing. The driving mechanism generates heat due to the pressure angle of gears engaging each other and the friction of sliding portions, such as the bearings. With the above-described collar positioned between the bearing and the toner screw conveyor, the heat generated by driving is transmitted to the interior of the development casing, increasing the temperature thereof.

Further, the toner is conveyed by the spiral portion of the second toner screw conveyer downstream in the toner transport direction, and then is sent to the development roller chamber by a rib that is located on the screw shaft of the second toner screw conveyer and extending parallel to the screw shaft. Consequently, it can happen that toner can accumulate in a given portion in the development device and is not transported by the toner screw conveyer due to a difference between sending pressure and returning pressure and changes in conveyance speed. Such accumulated toner generates pressure (toner powder pressure) on the extreme downstream portion of the screw shaft, the toner powder pressure presses the flange portion of the collar extending around the screw shaft in a direction orthogonal to the screw shaft, and the collar easily becomes hot. When the temperature of the collar reaches the melting point of the toner, the toner may coagulate, and then is fused and adhered to the flange portion, which is a phenomenon called fusing adhesion.

The coagulated toner formed on the flange portion of the collar can drop therefrom when the driving mechanism stops or the like, and the toner fragment thus dropped can easily separate into smaller pieces. If these fragments get to the development roller, the development roller may not carry the toner uniformly, which is a problem in that it adversely affects image quality.

In view of the foregoing, there is market demand for a development device capable of preventing fusing adhesion caused by the pressure and the temperature in the development device.

SUMMARY OF THE INVENTION

In view of foregoing, one illustrative embodiment of the present invention provides a development device that includes a screw conveyer to convey powder contained in a development casing in a direction along a shaft of the screw conveyer, a bearing in which the screw conveyer is inserted, a cylindrical member provided around the screw conveyer and disposed between the screw conveyer and the bearing, the cylindrical member including a flange portion that projects from the cylindrical member toward an outside diameter of the shaft of the screw conveyer, and a powder pressure disperser to reduce pressure of the powder transported by the screw conveyer, provided upstream from the flange portion in a direction in which the screw conveyer conveys the toner. The powder pressure disperser is provided around and extending outward in directions perpendicular to the shaft of the screw conveyer and has an outer diameter larger than an outer diameter of the flange portion.

Another illustrative embodiment of the present invention provides a process cartridge that includes an image carrier to carry an image, and the development device described above.

Another illustrative embodiment of the present invention provides an image forming apparatus that includes a process cartridge including an image carrier to carry a latent image and a development device described above to develop the latent image formed on the image carrier with toner.

BRIEF DESCRIPTION OF THE DRAWINGS

A more complete appreciation of the disclosure and many of the attendant advantage thereof will be readily obtained as the same becomes better understood by reference to the following detailed description when considered in connection with the accompanying drawings, wherein.

DETAILED DESCRIPTION OF PREFERRED EMBODIMENTS

Figure 1:
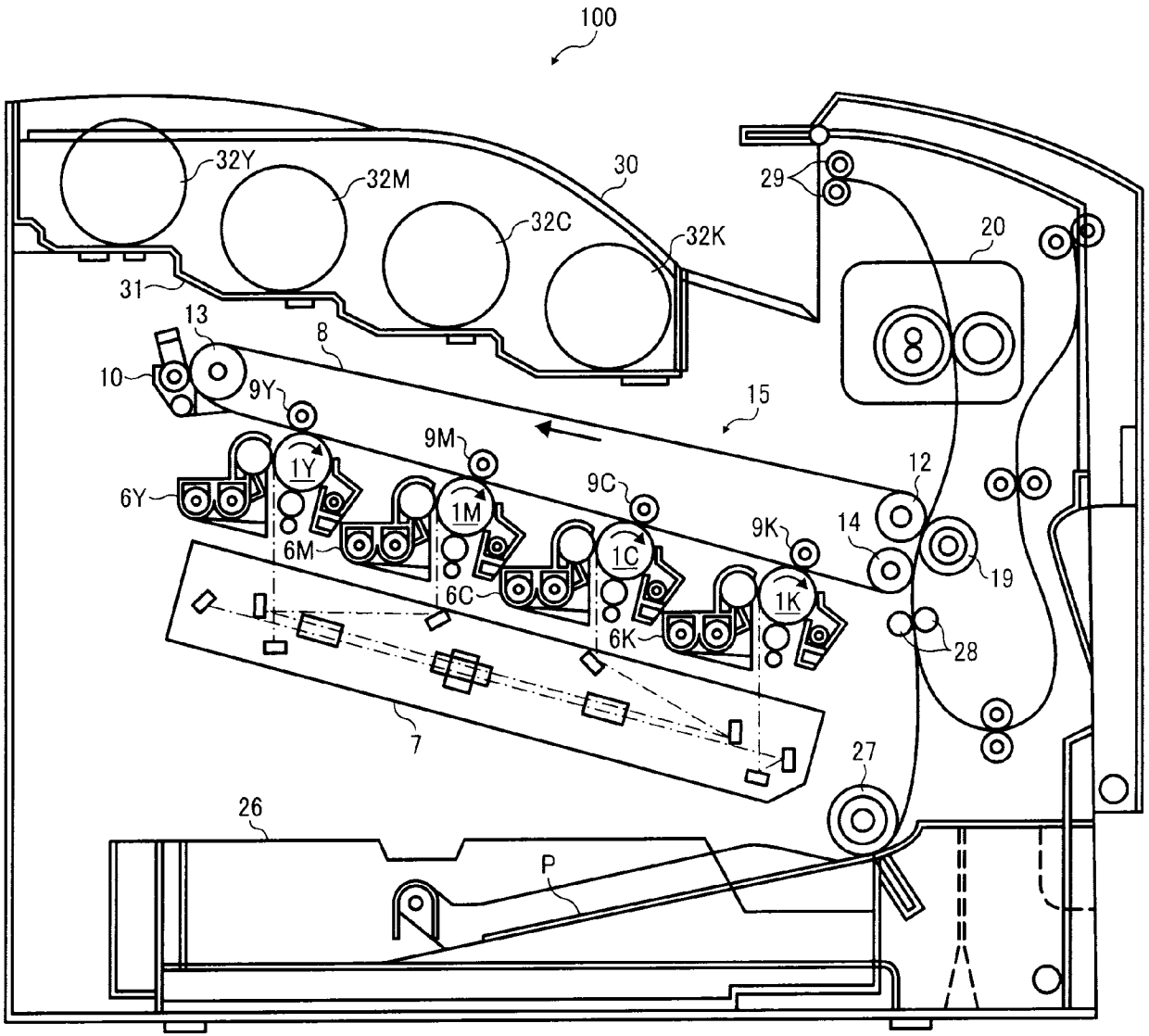
FIG. 1 is a schematic diagram illustrating a configuration of an electrophotographic printer according to an illustrative embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

First Embodiment

Referring now to the drawings, wherein like reference numerals designate identical or corresponding parts throughout the several views thereof, and particularly to FIG. 1, an image forming apparatus that is an electrophotographic printer (hereinafter referred to as a printer) according to an illustrative embodiment of the present invention is described. It is to be noted that although the image forming apparatus of the present embodiment is a printer, the image forming apparatus of the present invention is not limited to a printer.

Further, an image forming unit is described as a process cartridge. FIG. 1 is a schematic diagram illustrating a configuration of an electrophotographic printer 100, and FIG. 2 shows a schematic configuration of a process cartridge 6Y for producing yellow toner images.

Initially, a basic configuration of the printer 100 is described below.

The printer 100 includes four process cartridges 1K, 1M, 1C and 1Y as the image forming units for forming black, magenta, cyan, and yellow (hereinafter also simply "Y, M, C, and Y") single-color toner images, respectively.

It is to be noted that the subscripts K, M, C, and Y attached to the end of each reference numeral indicate only that components indicated thereby are used for forming yellow, magenta, cyan, and black images, respectively. However, each process cartridge 6K, 6M, 6C, and 6Y has a similar configuration except for the color of toner used therein as an image forming material. The each process cartridge is replaced when the process cartridge comes to the end of its useful life.

Using the process cartridge 6Y as an example, the configurations of the process cartridges 6K, 6M, 6C, and 6Y are described below.

As shown in FIG. 2, the process cartridge 6Y includes a drum shaped photoreceptor 1Y, a drum cleaning device 2Y, a discharging device, not shown, a charging device 4Y, and a development device 5Y.

The process cartridge 6Y is removably installable to the printer 100, and thus consumable items can be replaced all at one time in the printer 100.

The charging device 4Y uniformly charges the outer circumferential surface of the photoreceptor 1Y that is rotated clockwise in FIG. 2 by a drive member, not shown.

The surface of the photoreceptor 1Y thus uniformly charged is exposed and scanned by a laser light L, after which it then carries an electrostatic latent image for yellow. The electrostatic latent image for yellow is developed into a Y toner image by the development device 5Y that uses the Y toner.

Figure 2:
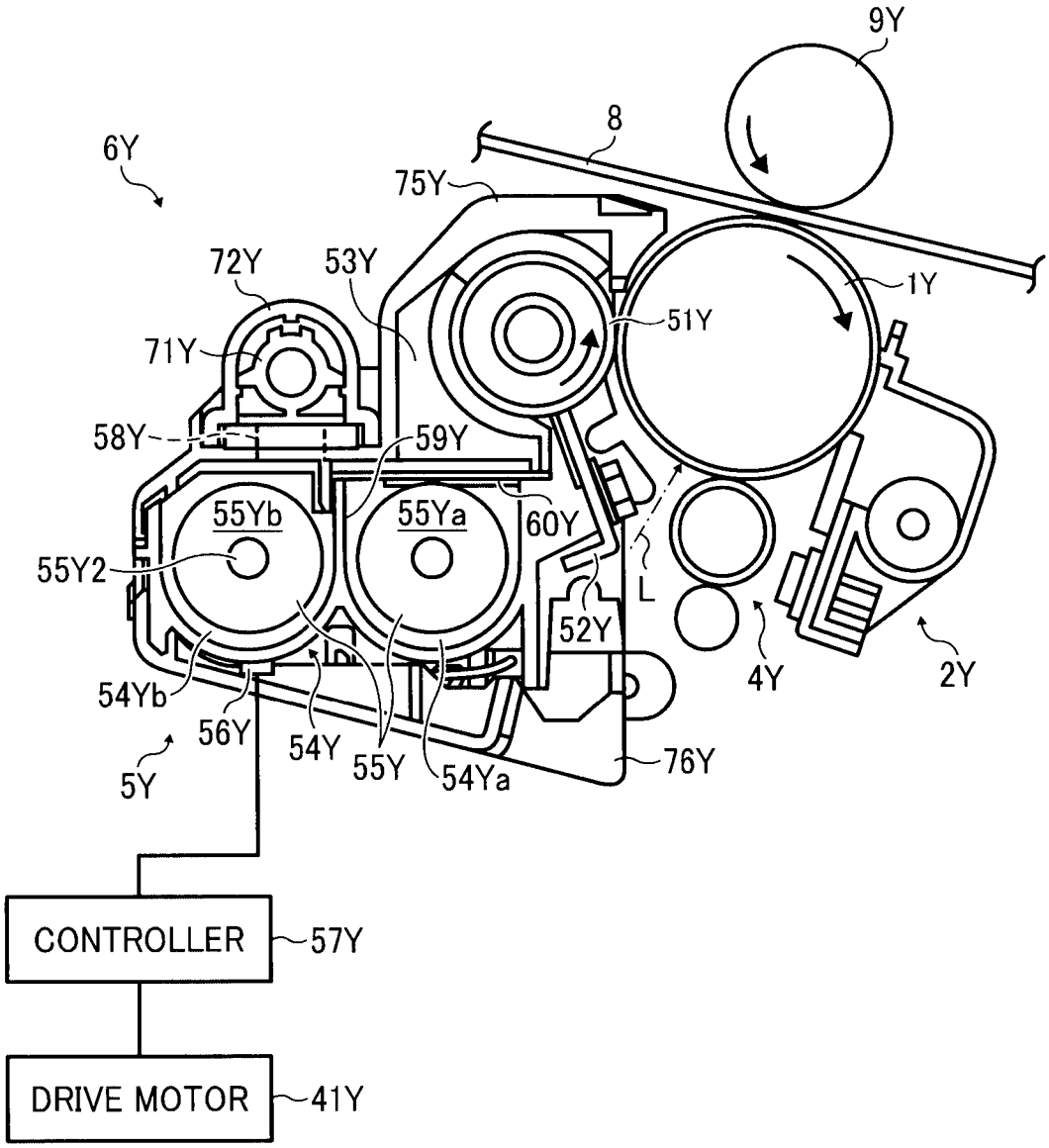
FIG. 2 shows a schematic configuration of a process cartridge for producing yellow toner images in the printer shown in FIG. 1.

Then, the Y toner image is transferred onto an intermediate transfer belt 8 shown in FIG. 1 in an intermediate transfer process.

The drum cleaning device 2Y removes residual toner remaining on the surface of the photoreceptor 1Y after the intermediate transfer process. The discharge device (not shown) discharges the residual charge on the surface of photoreceptor 1Y after the above-described cleaning process. Thus being discharged, the surface of photoreceptor 1Y is initialized, and thereafter, the printer 100 is readied for the next image forming process. Other process cartridge 6M, 6C, and 6K, similarly to the above description, respectively form magenta, cyan, and black toner images on the photoreceptor drums 1M, 1C, and 1K, and then the toner images thereon are initially transferred onto the intermediate transfer belt 8.

As shown in FIG. 1, beneath the process cartridges 6Y, 6M, 6C, and 6K, an exposure device 7 is disposed. The exposure device 7 includes laser light sources, not shown, such as laser diodes that irradiate the respective photoreceptor drums 1 in the process carriages 6 with the laser beams L in accordance with image data.

Due to this exposure process, electrostatic latent images for Y, M, C, and K are respectively formed on the photoreceptor drums 1. In the exposure device 7 the laser beams L emitted from the laser light source are deflected by a polygon mirror driven by a motor, not shown, so that the laser beams L scan the surfaces of photoreceptors 1 via multiple optical lenses and mirrors.

Beneath the exposure device 7, a feeding mechanism that includes a transfer-sheet cassette 26, a feed roller 27 incorporated in the transfer-sheet cassette 26, and a pair of registration rollers 28 is disposed. The transfer-sheet cassette 26 contains a stack of the multiple transfer sheets P, serving as recording media, and the feed roller 27 contacts the transfer sheet P on the top. When the feed roller 27 is rotated counterclockwise in FIG. 1, by a drive member, not shown, the transfer sheet P on the top is fed toward and between the registration rollers 28.

The pair of the registration rollers 28 rotates to sandwich the transfer sheet P and stops rotating soon after sandwiching the transfer sheet P therebetween. Then, the registration rollers 28 send the transfer sheet P to a secondary transfer nip at an appropriate timing.

In the feeding device configured as described above, the feeding roller 27 and the registration roller 28, serving as a timing roller, together form a transporting mechanism. The transporting mechanism transports the transfer sheet P from the transfer-sheet cassette 26 to the secondary transfer nip.

Above the process cartridge 6 in FIG. 1, an intermediate transfer device 15 that includes the intermediate transfer belt 8 extended around the intermediate transfer device 15 is disposed. The intermediate transfer belt 8 serves as an intermediate transfer member. The intermediate transfer unit 15 further includes four primary transfer rollers 9Y, 9M, 9C, and 9K, and a cleaning device 10.

Additionally, in the intermediate transfer unit 15, a secondary transfer backup roller 12, a cleaning backup roller 13, and a tension roller 14 are disposed. The intermediate transfer belt 8 that is a seamless belt extended around the above-described three rollers is rotated counterclockwise in FIG. 1 by rotating at least one of the rollers.

The intermediate transfer belt 8 is sandwiched between the primary transfer bias rollers 9Y, 9M, 9C, and 9K and the photoreceptors 1Y, 1M, 1C, and 1K to form respective primary transfer nips therebetween. Each primary transfer bias roller 9 applies transfer bias that has a reverse polarity (e.g., positive polarity) to the polarity of the toner to a back side (inner circumferential face) of the intermediate transfer belt 8.

All the above-described rollers, except the primary transfer rollers 9, are electrically grounded.

While a surface (outer circumferential surface) of the intermediate transfer belt 8 is moved through the primary transfer nip for yellow, magenta, cyan, and black, the Y, M, C, and K toner images on the photoreceptor drums 1Y, 1M, 1C, and 1K are primarily transferred and superimposed one on another onto the surface of intermediate transfer belt 8. Therefore, a four-color superimposed toner image (hereinafter referred to as a four-color toner image) is formed on the surface of intermediate transfer belt 8.

The intermediate transfer belt 8 is sandwiched between the secondary transfer backup roller 12 and a secondary transfer roller 19, and the secondary transfer nip is formed therebetween. The four-color toner image formed on the intermediate transfer belt 8 is transferred to the transfer sheet P at the secondary transfer nip.

Residual toner that is not transferred onto the transfer sheet P but adheres to the surface of the intermediate transfer belt 8 after the intermediate transfer belt 8 has passed through the transfer nip N2 is removed therefrom by the cleaning device 10.

At the secondary transfer nip, as the transfer sheet P is sandwiched between the intermediate transfer belt 8 and the secondary transfer roller 19 both rotating in a forward direction, the transfer sheet P is transported in a direction away from the registration rollers 28. The four-color toner image is fixed on the surface of the transfer sheet P with heat and pressure while the transfer sheet P passes through the rollers in the fixing device 20 after passing through the secondary transfer nip.

Thereafter, the transfer sheet P is discharged outside of the printer 100 via a pair of discharging sheet rollers 29.

A stack portion 30 is located on the top side of the printer 100. The transfer sheets P discharged outside by the pair of discharge sheet rollers 29 are sequentially stacked on the stack portions 30. It is to be noted that, beneath the stack portion 30, a bottle container 31 is disposed, and the bottle container 31 contains four toner bottles 32Y, 32M, 32C, and 32K.

Next, a configuration of the development device 5Y in the process cartridge 6Y is described below, with reference to FIG. 2.

The development device 5Y includes a development roller 51Y and a doctor blade 52Y. The development roller 51Y includes a magnetic field generator inside and serves as a developer carrier, with a two-component developer containing magnetic particles (e.g., magnetic carrier) and the toner on its surface. The doctor blade 52Y serves as a developer regulator that regulates a layer thickness of the developer carried and transported on the development roller 51Y.

The development roller 51 is contained in an upper container portion 53Y, and the developer (toner) is contained in a lower container portion 54Y. The lower container portion 54Y is provided with toner screw conveyors 55Y (a first screw conveyor 55Ya and a second screw conveyor 55Yb) that agitate and convey the toner, and a toner supply port 58Y through which the toner is supplied from the toner bottle 32Y set to the lower container portion 54Y is formed in the lower container portion 54Y. The lower container portion 54Y is partially but not completely separated by a partition wall 59Y into a first lower chamber 54Ya and a second lower chamber 54Yb, and the first lower chamber 54Ya is connected to the second lower chamber 54Yb via communication passages A and B (shown in FIG. 3).

Above the toner supply port 58Y, a shutter 71Y to close the toner supply port 58Y and a toner supply port case 72 to cover the toner supply port 58Y are disposed. The development device 5Y is entirely surrounded by an upper casing 75Y that includes an interior wall of the upper container portion 53Y and a lower casing 76Y that includes an interior wall of the lower container portion 54Y.

Further, a toner concentration sensor 56Y is disposed on a lower outer wall of the second lower chamber 54Yb to detect toner concentration of the developer therein. When the sensor 56Y detects that the toner concentration in the second lower chamber 54Yb is diminished, in accordance with a supply signal, a controller 57Y rotates a drive motor 41Y. Then, the toner bottle 32Y (shown in FIG. 1) is rotated, and the toner is supplied to the second lower chamber 54Yb.

Figure 3:
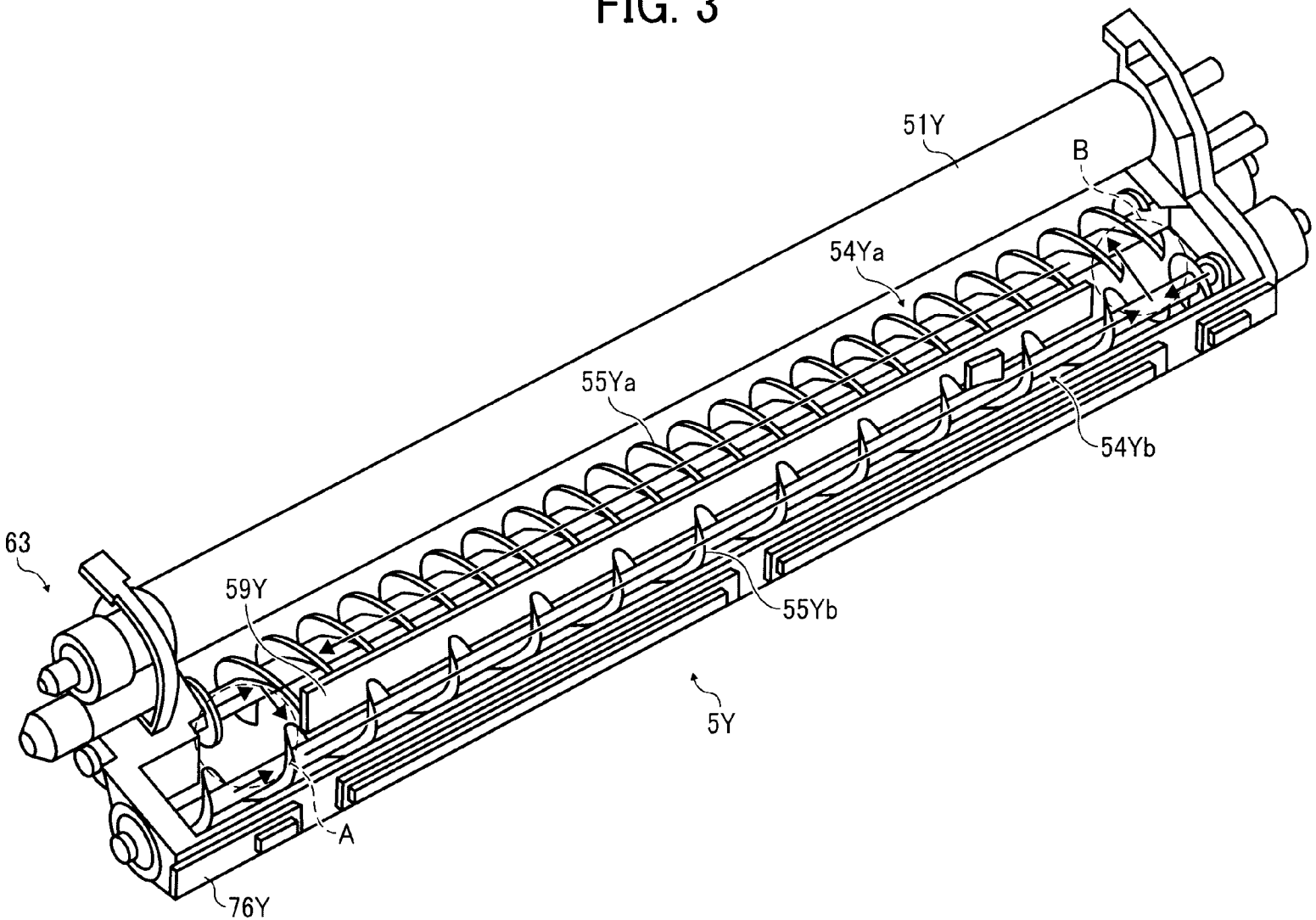
FIG. 3 is a perspective diagram illustrating a configuration of the development device incorporated in the process cartridge shown in FIG. 2.
Figure 4:
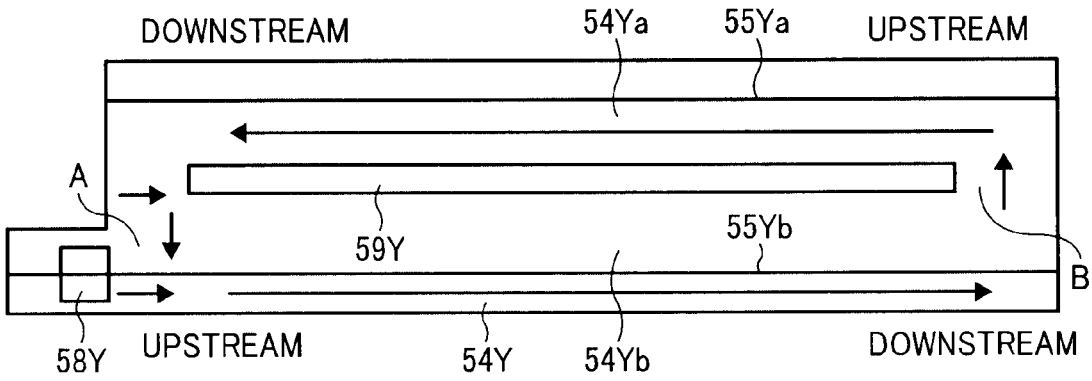
FIG. 4 is a schematic diagram illustrating circulation of the toner in the development device shown in FIG. 3.
Figure 5:
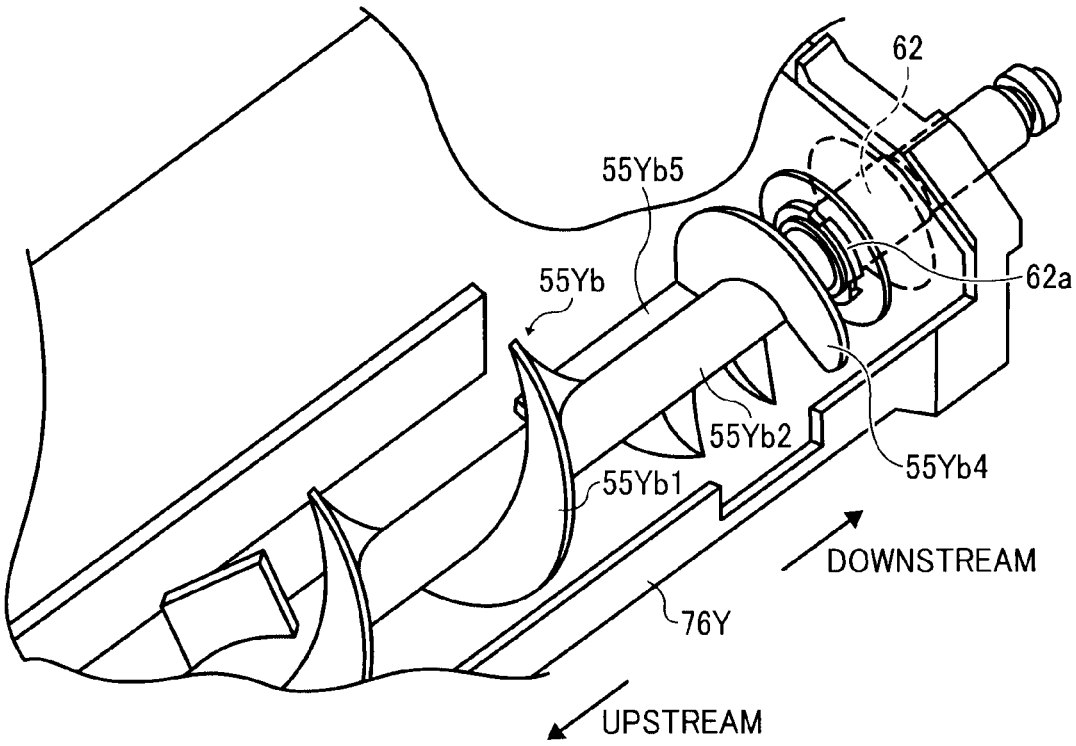
FIG. 5 is a schematic diagram illustrating a part of a second screw conveyer disposed in a second lower chamber shown in FIG. 3.

FIG. 3 is a perspective diagram illustrating a configuration of the development device 5Y of the present embodiment. FIG. 4 is a schematic diagram illustrating circulation of the toner in the development device 5Y shown in FIG. 3. FIG. 5 is a schematic diagram illustrating a part of the second screw conveyer 55Yb disposed in the second lower chamber 54Yb. It is to be noted that FIG. 2, which illustrates the schematic configuration of the process cartridge 6Y for producing yellow toner images, corresponds to an end-on cross sectional view of the process cartridge 6Y viewed from the right in FIG. 3.

In FIG. 3, the upper casing 75Y, the toner supplying port 58Y, the shutter 71Y to close the toner supplying port 58Y, and the toner supply port case 72Y to cover the toner supply port 58Y are omitted for simplicity. In addition, in FIG. 5 the first screw conveyor 55Ya is also omitted for simplicity.

As described above, the two-component type development device 5Y using the two-component developer including the magnetic carrier and the toner includes the toner screw conveyors 55Y so as to agitate and convey the replenished toner and the carrier. Each of the toner screw conveyors 55Y has a shaft with a spiral to convey the toner unidirectionally.

As shown in FIGS. 3 and 4, in the development device 6 of the present embodiment, the first lower chamber 54Ya is provided with the first screw conveyor 55Ya to convey the toner, and the second lower chamber 54Yb is provided with the second screw conveyor 55Yb to convey the toner.

As the toner is consumed, more toner is supplied from the toner supply port 58Y disposed in an upper portion of the lower container portion 54Y. The replenished toner is conveyed toward a downstream portion of the second lower chamber 54Yb along a spiral portion 55Yb1 of the second screw conveyor 55Yb in a direction in which the toner is transported while mixed with the carrier in the lower container portion 54. Arrows shown in FIG. 4 indicate directions in which the toner is transported (hereinafter "toner transport direction").

As is clear in FIG. 4, in which the development roller 51Y is omitted, the partition wall 59Y between the first lower chamber 54Ya and second lower chamber 54Yb does not extend the entire length of the lower casing 76Y, and both side portions where the partition wall 59 is opened function as the communication passages A and B.

As shown in FIG. 5, when the spiral portion 55Yb1 conveys the toner to the downstream portion of the lower second chamber 54Yb in the toner transport direction, a downstream bearing 80 (shown in FIG. 6A) of the second screw conveyor 55Yb receives pressure from the conveyed toner and the toner leaks out from tiny gaps between a screw shaft 55Yb2 and the downstream bearing 80. To solve this problem, the downstream portion of the second screw conveyor 55Yb in the toner transport direction is provided with a reverse spiral portion 55Yb4 to move the toner in the opposite direction and relieve the pressure on the downstream bearing 80.

To reduce the cost of components for lower- and intermediate-speed printers that are relatively inexpensive, the second screw conveyer 55Yb may be formed of a resin material. However, it is difficult to form a complete circle by using only resin material, and accordingly, the toner can leak from between the bearing 80 and the second screw conveyor 55Yb (hereinafter also "bearing assembly"). Therefore, when the second screw conveyor 55Yb is formed of the resin material, a metal collar (cylindrical member) 62 or the like is fitted around the second screw conveyor 55Yb where the bearing 80 is disposed (that is, an engagement portion between the bearing 80 and the second screw conveyor 55Yb).

There are additional obstacles. For example, on the outer wall of the lower casing 76Y, a driving mechanism 63 (shown in FIG. 3) to rotate the toner screw conveyors 55 and the development roller 51Y is located. Due to the pressure angle of gears engaging each other and friction of sliding portions such as the bearing assembly, the driving mechanism 63 generates heat.

Additionally, in order to fit the collar 62 around the screw shaft 55Yb2 using a pressing tool without damaging the screw shaft 55Yb2, a flange portion 62*a* that projects from one end portion of the collar 62 toward an outside diameter of the screw shaft 55Yb2 is provided.

As a comparative example, when only the collar 62 is disposed on the bearing assembly, heat from the driving mechanism 63 and the like is transmitted to the interior of the printer, thus increasing the interior temperature of the printer. Meanwhile, the toner is conveyed by the spiral portion 55Yb1 toward the downstream side thereof and then is sent to the upper container portion 53Y (development roller container) by a rib 55Yb5 shaped like a rectangular flat plate extending parallel to the screw shaft 55Yb2 and projecting from the surface of the screw shaft 55Yb2 of the toner screw conveyer 55Yb. Due to toner accumulated by a difference between sending pressure and returning pressure, and a change of conveyance speed, pressure (toner powder pressure) toward the extreme downstream portion of the screw shaft 55Yb2 is generated. The toner powder pressure is exerted against the flange portion 62*a* of the metal collar 62, the heat generated by driving the development device 5Y is easily transferred to the collar 62, and the collar 62 becomes hot. When the temperature reaches a softening point of the toner, the toner contacting the flange portion 62*a* coagulates and then is fused and adheres thereto. The toner coagulation formed on the flange portion 62*a* in the collar 62 falls therefrom when the driving mechanism 63 stops or the like, and the fallen toner fragments can easily separate into smaller pieces. As these fragments are conveyed to the development roller 51Y, the development roller 51Y may not carry the toner uniformly.

Figure 6A:
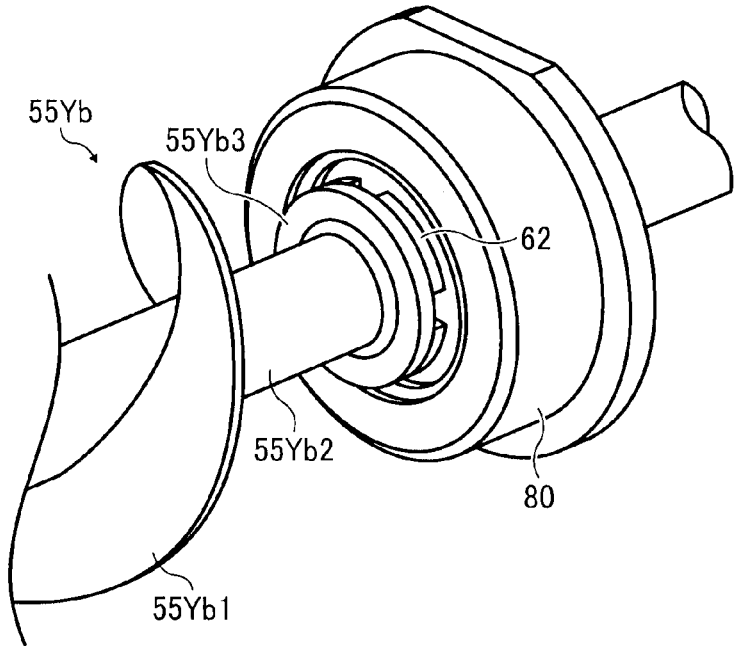
FIGS. 6A and 6B are a perspective view and a vertical section view respectively illustrating configurations of a bearing assembly in the development device shown in FIG. 3.

In order to prevent the toner from coagulating, as shown in FIG. 6A, a washer 55Yb3 provided around and extending outward in directions perpendicular to the screw shaft 55Yb2 is provided upstream from the collar 62 in the direction in which the second screw conveyer 55Yb transports the toner. The collar 62 is attached to the washer 55Yb3, so that the upstream side surface of the flange portion 62*b* of the collar 62 closely contacts the downstream side surface of the washer 55Yb3. The washer 55Yb3 serves as a powder pressure disperser, and for this reason an external diameter of the washer 55Yb3 is larger than the flange portion 62*a* of the collar 62.

Figure 6B:
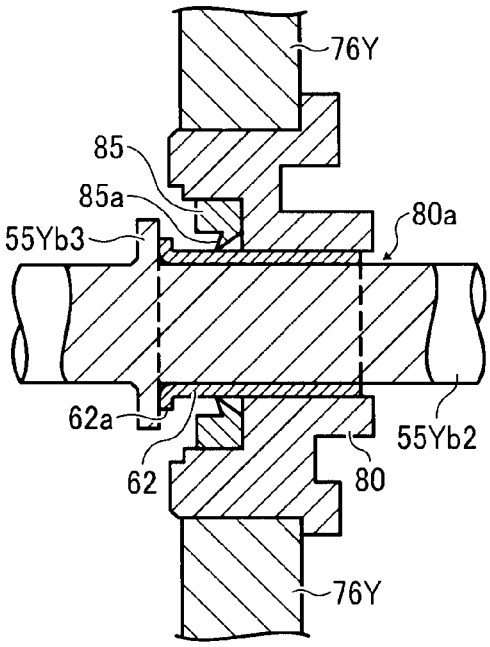
Figure 6C:
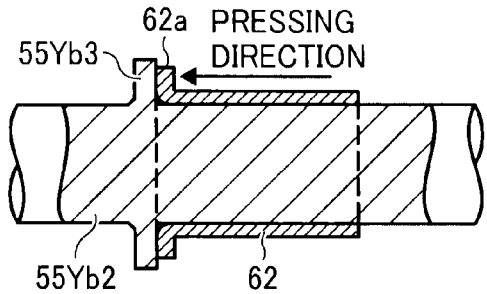
FIG. 6C is a view illustrating a fabrication process of the bearing assembly.

FIGS. 6A and 6B are a perspective view and a vertical section view respectively illustrating configurations of the bearing assembly, and FIG. 6C is a view illustrates a fabrication process of the bearing assembly. The bearing assembly rotatably supports the screw shaft 55Yb2 and prevents the toner leakage. The bearing assembly includes the bearing 80, the collar 62 (cylindrical member), a seal member 85, and the washer 55Yb3.

In the present embodiment, the bearing 80 is a plain bearing and receives the screw shaft 55Yb2 with a sliding inner circumferential surface thereof, and FIG. 6B shows the cross section of the bearing assembly. The outer circumferential surface of the bearing 80 is fitted in a hole formed in the development casing 76Y. Then, the screw shaft 55Yb2 and the collar 62 engaged around the screw shaft 55Yb2 are inserted in the inner circumferential surface (bearing port 80*a*) of the bearing 80.

The seal member 85 that is cylindrical and is formed of an elastic material is disposed on the inner circumferential surface of the bearing port 80*a*. Additionally, the seal member 85 is located and fitted around the outer circumferential surface of the collar 62.

As shown in FIG. 6B, the seal member 85 includes a thin-walled packing portion 85*a* of reduced thickness that obliquely and inwardly projects toward the interior of the seal member 85. When the screw shaft 55Yb2 is inserted into the bearing port 80*a*, an edge portion of the packing portion 85*a* contacts the outer circumferential surface of the collar 62 fitted around the screw shaft 55Yb2 and seals the periphery of the screw shaft 55Yb2 to prevent the toner from leaking from the periphery of the screw shaft 55Yb2.

It is to be noted that although in the present embodiment the sliding screw bearing in which the screw shaft slides on the inner circumferential surface of the bearing is used as the bearing 80, the bearing is not limited thereto, and other bearing configurations such as a ball bearing can be used.

Next, the reason why the collar 62 is located between the screw shaft 55Yb2 and the bearing 80 is described below, with reference to FIG. 6B.

As described above, in the bearing assembly, the packing portion 85*a* of the seal member 85 seals the periphery of the screw shaft 55Yb2 by contacting the outer circumferential surface of the collar 62 to prevent toner leakage. Because the screw shaft 55Yb2 rotates inside the stationary bearing 80, as the degree of roundness of the screw shaft 55Yb2 increases, the packing portion 85*a* more closely contacts the screw shaft 55Yb2, and sealing is improved.

Meanwhile, in terms of cost performance, fitting the collar 62 whose outer circumference is perfectly round or nearly perfectly round around the screw shaft 55Yb2 is better than processing (by e.g., scraping) the screw shaft 55Yb2 so that a cross section of the screw shaft 55Yb2 is perfectly round.

Additionally, even when the screw shaft 55Yb2 is formed of a resin that is affordable and easily-processed but can deform easily, by covering the screw shaft 55Yb2 formed of deformable resin with the collar 62 formed of material (e.g., metal) that is harder than the screw shaft 55Yb2, the portion that contacts the seal member 85 can be made perfectly round or nearly perfectly round.

Therefore, in the present embodiment, the collar 62 is fitted around the outer circumferential surface of the screw shaft 55Yb2, and the collar 62 contacts the packing portion 85*a*.

Next, with reference to FIG. 6C, the fabrication process of the bearing assembly, that is, the process of pressing and fitting the collar 62 around the screw shaft 55Yb2, is described below because the usefulness of the flange portion 62*a* of the collar 62 becomes most apparent in this process.

When the collar 62 is pressed and fitted around the screw shaft 55Yb2, the flange portion 62*a* is pressed in a direction indicated by an arrow shown in FIG. 6C by using a pressing tool, and thus, the collar 62 is snugly fitted around the outer circumferential surface of the screw shaft 55Yb2.

If, for example, the collar 62 does not have the flange portion 62*a*, a thin-walled end of collar 62 is pressed. However, because it is difficult to press the thin-walled end portion thereof to begin with, and moreover a portion that is slightly askew of a desired area can allow the pressing tool to slip from the end portion of the collar 62 and stick into and break the second screw conveyer 55Yb.

By contrast, in the present embodiment, the flange portion 62*a* is disposed on one end of the collar 62 in the axial direction of the second screw conveyer 55Yb, thereby stabilizing and thus facilitating the above-described pushing process.

Further, the collar 62 is pushed to a portion where the flange portion of 62*a* contacts the washer 55Yb3 which functions as a stopper. After the collar 62 is pushed around the screw shaft 55Yb2, the screw shaft 55Yb2 is fitted into the bearing assembly that is fitted in the development device 5Y in advance, and thus, the screw conveyer 55Yb is attached to the development device 5Y.

It is to be noted that the order of fabrication of the bearing and the development device is not fixed, and the embodiment according to the present invention can select from among them suitably. Moreover, the above-described bearing assembly fabrication process can be applied to not only the present embodiment but also the following embodiments in this specification.

Second Embodiment

Figure 7A:
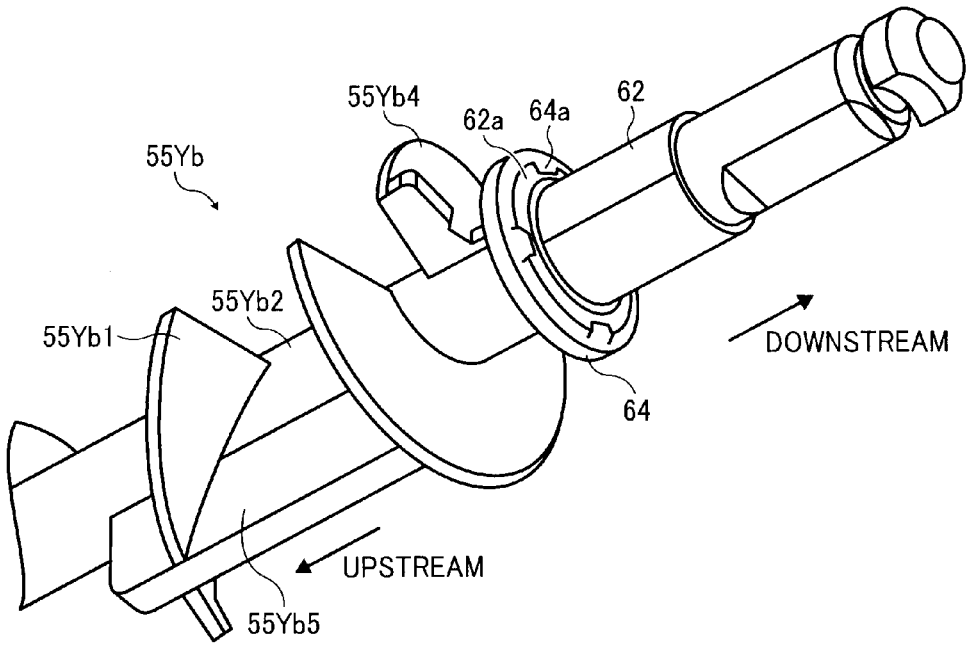
FIG. 7A is an expanded view illustrating the vicinity of a washer of the second screw conveyer 55Yb2 according to another embodiment.
Figure 7B:
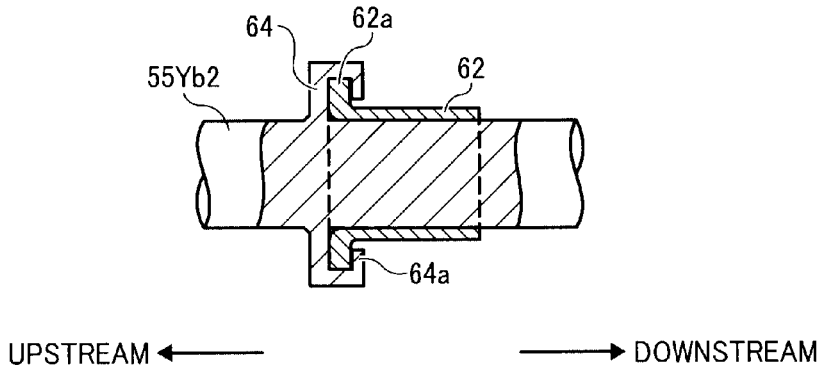
FIG. 7B is a cross sectional diagram illustrating a basic configuration around the washer shown in FIG. 7A.

FIG. 7A is an expanded view illustrating the vicinity of a washer 64 of the second screw conveyer 55Yb2 according to a second embodiment. FIG. 7B is a cross sectional diagram illustrating a basic configuration of the washer 64 area shown in FIG. 7A.

In the configuration shown in FIG. 7A, instead of the above-described washer 55Yb3 shown in FIG. 6A, the washer 64 is provided. The washer 64 also serves as a powder pressure disperser. Similar to the above configuration, the washer 64 is formed of a material whose heat-conductivity is lower than that of the metal collar 62, and its external diameter is larger than that of a flange portion 62*a* of the collar 62.

Additionally, in the present embodiment, the flange portion 62*a* is at least partially enveloped by the washer 64. More specifically, the flange portion 62*a* shaped like a flat plate circularly extending around the screw shaft 55Yb is located in the upstream edge of the metal collar 62 in the toner transport direction.

Herein, an upstream surface of the flange portion 62*a* of the metal collar 62 closely contacts the downstream surface of the washer 64. That is, the collar 62 is attached to the washer 64 so that the surface of the flange portion 62*a* in the collar 62 closely contact the surface of the washer 64 where these portions face each other.

The collar 62 and the washer 64 are brought together by one or more pawls 64*a* formed on the washer 64. The pawls 64*a* serve as multiple discontinuous projection portions. More particularly, the pawls 64*a* project from the washer 64 and create a space into which the flange portion 62*a* of the collar 62 is inserted so as to secure the flange portion 62*a*. Because the pawl 64*a* elastically deform, the pawls 64 can support the collar 62.

As described above, the washer 64 that at least partially envelopes the flange portion 62*a* is formed of a material whose heat-conductivity is lower than that of the metal collar 62. As for the materials of the washer 64, such as resin, rubber, and leather that have the low heat-conductivity can be adapted.

As shown in FIGS. 7A and 7B, the external diameter of the washer 64 is larger than that of the flange portion 62*a* of the collar 62, and the washer 64 is located upstream from the flange portion 62*a* in the toner transport direction. Therefore, the metal collar 62, which becomes hot, is shielded from the pressure (toner powder pressure) from the conveying force of the second screw conveyer 55Yb. Therefore, the toner can be better prevented from coagulating when the washer 64 is further provided than when only the metal collar 62 is provided.

Further, if the above-described flange 62*a* is not provided, initially, when the collar 62 is pressed and fitted around the screw shaft 55Yb2, the screw shaft 55Yb2 may be damaged. Then, while the development process is performing in the development device 5Y, the toner powder pressure generated by the second screw conveyer 55Yb2 is applied to the seal member 85 (shown in FIG. 6B) in the bearing assembly, and the toner leaks out to the outside of the printer.

By contrast, in the present embodiment, while the member that receives the pressure of the transported toner (the flange portion 62*a*) is provided, toner coagulation can be prevented. Therefore, the configuration can attain reliable sealing of the bearing seal member and reduction in the coagulation of the toner.

Additionally, in the present embodiment, because the surfaces of the flange portion 62*a* closely contact the surfaces of the washer 64 surrounding around the flange portion, the toner does not get into a gap between the flange 62*a* and the collar 64, and therefore, the coagulation of the toner therebetween can be reduced.

Third Embodiment

Figure 8:
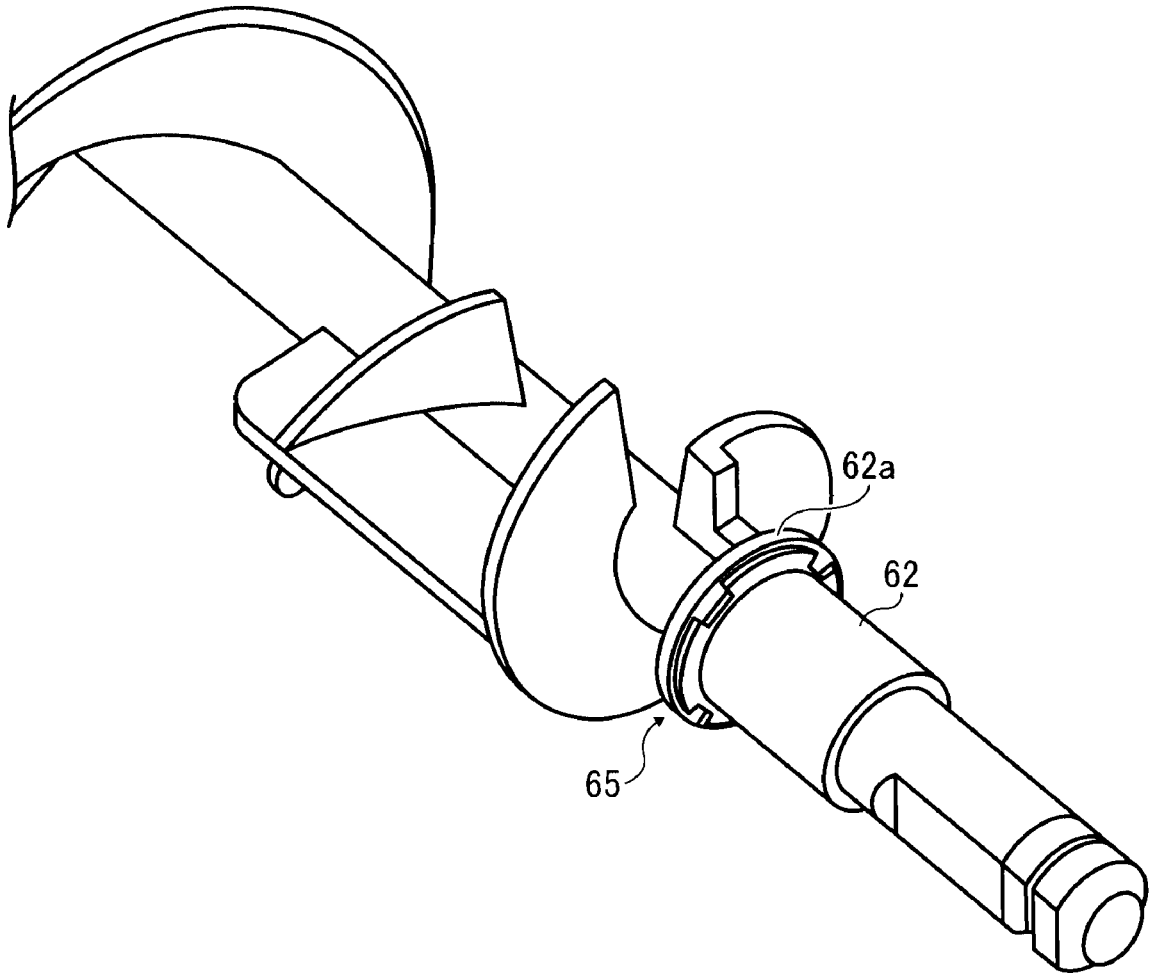
FIG. 8 is a perspective expanded view illustrating the vicinity of an integrated type washer according to another embodiment.

FIG. 8 is a perspective expanded view illustrating an integrated type washer 65 and the adjacent area.

In the configuration shown in FIG. 8, the washer 65 serves as a powder pressure disperser. Unlike the washers 55Yb3 and 64 in the first and second embodiments, respectively, the washer 65 that covers a flange portion 62*a* of the collar 62 is integrally formed with and on the second screw conveyer 550Yb formed of a resin whose heat-conductivity is lower than the metal. In FIG. 8, the external diameter of the integrated type washer 65 is larger than that of the flange portion 62*a* of the collar 62, and the washer 65 is located upstream from the flange portion 62*a* in the toner transport direction. Thus, the metal collar 62 is shielded from the pressure from the conveying force of the second screw conveyer 550Yb, and therefore, the coagulation of the toner can be prevented inexpensively.

Additionally, although current image forming apparatuses generally enter a standby state while waiting for printing so as to save energy, it is required to shorten a recovery time from the standby state. Raising a temperature of the fixing mechanism to fix the transferred toner with heat and pressure to a predetermined fixable temperature requires a longest time in the recovery from the standby state. Therefore, many devices decrease the fixable temperature by using toner that has a lower melting point. Effects of the development devices according to the above-described various embodiments can be enhanced using the toner that has a lower melting point.

In the present invention, the location of the above-described washer 55Yb3, 64, or 65 is not limited to the downstream portion of the second screw conveyer 55Yb, but also applicable to the downstream portion of the first screw conveyer 55Ya.

A variation of the above-described various embodiments is described below with reference to FIG. 9.

Figure 9:
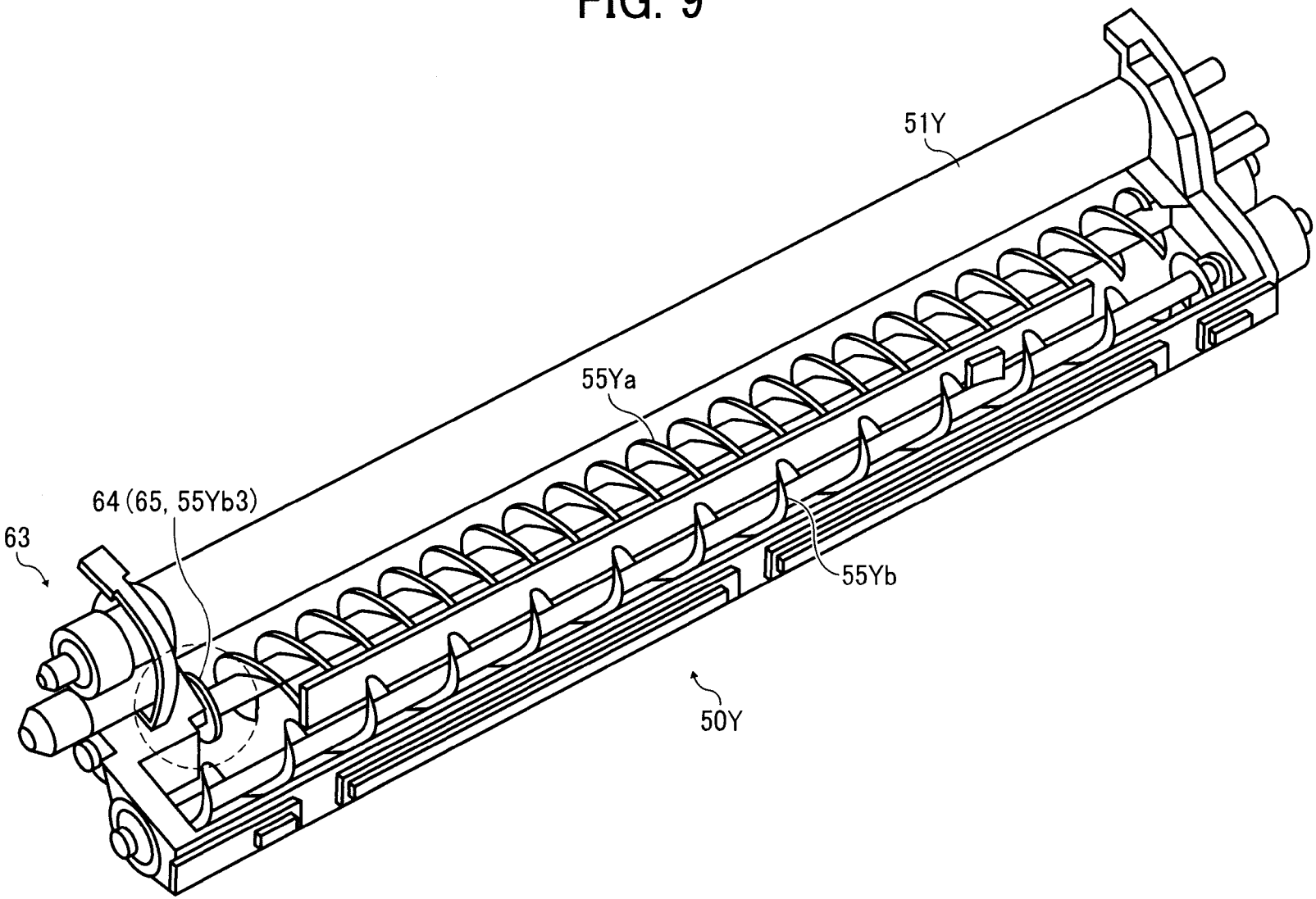
FIG. 9 is a perspective view illustrating a development device in which a power pressure disperser is disposed on the downstream side of a first screw conveyer that conveys the toner toward a driving mechanism.

FIG. 9 is a perspective view illustrating a development device 50Y in which the power pressure disperser is disposed on the downstream side of the first screw conveyer 55Ya that conveys the toner toward the driving mechanism 63. The power pressure disperser can be any of the washer 55Yb3, 64, and 65. The powder pressure disperser is formed of a material of lower heat-conductivity. In FIG. 9, the power pressure disperser that covers the flange 62*a* (shown in FIG. 7B) is located in the downstream portion of the first screw conveyer 55Ya conveying the toner to the driving mechanism 63 under high temperature and high pressure.

More specifically, the driving members (the development roller 51Y and the screw roller) are coupled with respective gears, not shown. A portion that receives a driving force from the image forming apparatus body is the gear that works as a heat mechanism 63 (heat generator). That is, a gear extended from the motor 41Y (shown in FIG. 2) provided in the image forming apparatus body intermeshes with the gear used as the heat generator 63, and when the gear used as the heat generator 63 rotates, the development roller 51Y and the screw conveyers 55Y rotate.

Herein, in the gear that is used as a source of the driving force and receives the strongest force in the development device 50Y, the intermeshing force is strong, and the friction heat is greater. Thus, the gear becomes the heat generator whose temperature is higher than other portions.

Referring to FIGS. 3 and 9, the first screw conveyer 55Ya in the lower container portion 54Y conveys the toner toward the heat side, and the second screw conveyer 55Yb conveys the toner toward opposite direction to the heat site. The pressure force (toner powder pressure) is present on the downstream side of both the screw conveyer 55Ya and the second screw conveyer 55Yb. However, the non-driving portion has no heat generator and its temperature is lower, and the toner is scarcely coagulated in the non-driving portion under the same pressure.

By contrast, in the driving portion, the toner is more easily coagulated than in the non-driving portion even if the receiving pressure is the same, and due to the coagulated toner, the toner is unevenly carried on the photoreceptor 1Y.

To reduce the unevenness of the toner distributed on the photoreceptor 1Y, in the present variation, the power pressure disperser (washer 64, 65, or 55Yb3) is disposed in the bearing assembly located close to the gear used as a heat generator (driving portion).

In the configuration shown in FIG. 9, the unevenness of the toner on the photoreceptor 1Y caused by the coagulation of the toner can be prevented or reduced.

If the toner is coagulated in the development device 5Y, the coagulated toner is transported to the development roller 51Y, and the toner is unevenly carried on the development roller 51Y. As a result, the toner is unevenly transferred onto the photoreceptor 1Y from the development roller 51Y. When the toner on the photoreceptor 1Y is uneven due to the coagulated toner, a white void in which toner is partly absent on the surface of the recording media along a direction in which the recording media is transported occurs.

The present configuration can prevent occurrence of such white voids, which, as noted above, is caused by the unevenness of the toner distribution due to the toner coagulation.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a screw conveyer to convey powder contained in a development casing in a direction along a shaft of the screw conveyer;

a bearing in which the screw conveyer is inserted;

a cylindrical member provided around the screw conveyer and disposed between the screw conveyer and the bearing, the cylindrical member including a flange portion that projects from the cylindrical member toward an outside diameter of the shaft of the screw conveyer; and a powder pressure disperser to reduce pressure of the powder transported by the screw conveyer, provided upstream from the flange portion in a direction in which the screw conveyer conveys the powder, the powder pressure disperser provided around and extending outward in directions perpendicular to the shaft of the screw conveyer and having an outer diameter larger than an outer diameter of the flange portion, the powder pressure disperser being formed of a material whose heat-conductivity is lower than that of the cylindrical member.

2. The development device according to claim 1, wherein the powder pressure disperser contacts the flange portion of the cylindrical member so that an upstream side surface of the flange portion of the cylindrical member contacts a downstream side surface of the powder pressure disperser.

3. The development device according to claim 2, wherein multiple discontinuous projection portions are provided on the powder pressure disperser at intervals, defining a space into which the flange portion of the cylindrical member is inserted and held, and the discontinuous projection portions are elastic.

4. The development device according to claim 1, wherein the powder pressure disperser is integrally formed with the screw conveyer as a single integrated unit.

5. The development device according to claim 1, wherein the screw conveyer conveys the powder toward a driving mechanism to drive the development device, and the power pressure disperser is disposed on the downstream side of the screw conveyer in the direction in which the screw conveyer conveys the powder.

6. A process cartridge comprising an image carrier to carry an image; and a development device including:

a screw conveyer to convey powder contained in a development casing in a direction along a shaft of the screw conveyer;

a bearing in which the screw conveyer is inserted;

a cylindrical member provided around the screw conveyer and disposed between the screw conveyer and the bearing, the cylindrical member including a flange portion that projects from the cylindrical member toward an outside diameter of the shaft of the screw conveyer; and a powder pressure disperser to reduce pressure of the powder transported by the screw conveyer, provided upstream from the flange portion in a direction in which the screw conveyer conveys the powder, the powder pressure disperser provided around and extending outward in directions perpendicular to the shaft of the screw conveyer and having an outer diameter larger than an outer diameter of the flange portion, the powder pressure disperser of the development device being formed of a material whose heat-conductivity is lower than that of the cylindrical member.

7. The process cartridge according to claim 6, wherein the powder pressure disperser of the development device contacts the flange portion of the cylindrical member so that an upstream side surface of the flange portion of the cylindrical member contacts a downstream side surface of the powder pressure disperser.

8. The process cartridge according to claim 7, wherein multiple discontinuous projection portions of the development device are provided on the powder pressure disperser at intervals, defining a space into which the flange portion of the cylindrical member is inserted and held, and the discontinuous projection portions are elastic.

9. The process cartridge according to claim 6, wherein the powder pressure disperser of the development device is integrally formed with the screw conveyer as a single integrated unit.

10. The process cartridge according to claim 6, wherein the screw conveyer of the development device conveys the powder toward a driving mechanism to drive the development device, and the powder pressure disperser is disposed on the downstream side of the screw conveyer in the direction in which the screw conveyer conveys the powder.

11. An image forming apparatus comprising:

a process cartridge comprising an image carrier to carry a latent image; and a development device to develop the latent image formed on the image carrier with toner, the development device including:

a screw conveyer to convey powder including the toner contained in a development casing in a direction along a shaft of the screw conveyer;

a bearing in which the screw conveyer is inserted;

a cylindrical member provided around the screw conveyer and disposed between the screw conveyer and the bearing, the cylindrical member including a flange portion that projects from the cylindrical member toward an outside diameter of the shaft of the screw conveyer; and a powder pressure disperser to reduce pressure of the powder transported by the screw conveyer, provided upstream from the flange portion in a direction in which the screw conveyer conveys the powder, the powder pressure disperser provided around and extending outward in directions perpendicular to the shaft of the screw conveyer and having an outer diameter larger than an outer diameter of the flange portion, the powder pressure disperser of the development device being formed of a material whose heat-conductivity is lower than that of the cylindrical member.

12. The image forming apparatus according to claim 11, wherein the powder pressure disperser of the development device contacts the flange portion of the cylindrical member so that an upstream side surface of the flange portion of the cylindrical member contacts a downstream side surface of the powder pressure disperser.

13. The image forming apparatus according to claim 12, wherein multiple discontinuous projection portions of the development device are provided on the powder pressure disperser at intervals, defining a space into which the flange portion of the cylindrical member is inserted and held, and the discontinuous projection portions are elastic.

14. The image forming apparatus according to claim 11, the powder pressure disperser of the development device is integrally formed with the screw conveyer as a single integrated unit.

15. The image forming apparatus according to claim 11, wherein the screw conveyer of the development device conveys the powder toward a driving mechanism to drive the development device, and the powder pressure disperser is disposed on the downstream side of the screw conveyer in the direction in which the screw conveyer conveys the powder.

16. The development device according to claim 1, wherein the powder comprises toner.

17. A development device comprising:

a screw conveyer to convey powder contained in a development casing in a direction along a shaft of the screw conveyer;

a bearing in which the screw conveyer is inserted;

a cylindrical member provided around the screw conveyer and disposed between the screw conveyer and the bearing, the cylindrical member including a flange portion that projects from the cylindrical member toward an outside diameter of the shaft of the screw conveyer;

a sealing member separate from the bearing and located between the cylindrical member and the bearing, the sealing member receiving an outer face of the cylindrical member, the sealing member configured to prevent the powder from leaking outside from a periphery of the bearing; and a powder pressure disperser to reduce pressure of the powder transported by the screw conveyer, provided upstream from the flange portion in a direction in which the screw conveyer conveys the powder, the powder pressure disperser provided around and extending outward in directions perpendicular to the shaft of the screw conveyer and having an outer diameter larger than an outer diameter of the flange portion.

* * * * *